US011396682B2

(12) United States Patent
Yu et al.

(10) Patent No.: US 11,396,682 B2
(45) Date of Patent: Jul. 26, 2022

(54) FREE MACHINING AND NON-QUENCHED AND TEMPERED STEEL AND MANUFACTURING METHOD THEREFOR

(71) Applicant: BAOSHAN IRON & STEEL CO., LTD., Shanghai (CN)

(72) Inventors: Dajiang Yu, Shanghai (CN); Xijun Jiang, Shanghai (CN); Zongze Huang, Shanghai (CN); Rui Huang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 210 days.

(21) Appl. No.: 16/621,512

(22) PCT Filed: Jun. 11, 2018

(86) PCT No.: PCT/CN2018/090627

§ 371 (c)(1),
(2) Date: Dec. 11, 2019

(87) PCT Pub. No.: WO2019/001250

PCT Pub. Date: Jan. 3, 2019

(65) Prior Publication Data

US 2020/0095650 A1 Mar. 26, 2020

(30) Foreign Application Priority Data

Jun. 29, 2017 (CN) ..... 201710514111.8

(51) Int. Cl.

| | |
|---|---|
| ***C21D 6/00*** | (2006.01) |
| ***C22C 38/14*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C22C 38/12*** | (2006.01) |
| ***C21D 9/46*** | (2006.01) |
| ***C21D 8/02*** | (2006.01) |

(52) U.S. Cl.

CPC ..... *C21D 9/46* (2013.01); *C21D 6/005* (2013.01); *C21D 6/008* (2013.01); *C21D 8/0205* (2013.01); *C21D 8/0226* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/005* (2013.01); *C21D 2211/009* (2013.01)

(58) Field of Classification Search

None

See application file for complete search history.

(56) References Cited

U.S. PATENT DOCUMENTS

2004/0223867 A1 11/2004 Tsunekage

FOREIGN PATENT DOCUMENTS

| | | | | |
|---|---|---|---|---|
| CN | 1502715 | A | * | 6/2004 |
| CN | 1502715 | A | | 6/2004 |
| CN | 1550562 | | | 12/2004 |
| CN | 101255535 | | | 9/2008 |
| CN | 105154774 | | | 12/2015 |
| EP | 1312689 | A1 | | 5/2003 |
| EP | 1316624 | A1 | | 6/2003 |
| JP | 2010265506 | | | 11/2010 |

OTHER PUBLICATIONS

International Search Report and Written Opinion dated Aug. 24, 2018 for PCT Patent No. PCT/CN2018/090627.
1st Office Action dated Mar. 11, 2020 for Chinese Patent Application No. 201710514111.8.
European Search Report dated Jan. 29, 2021 for European Patent No. 18824663.

* cited by examiner

*Primary Examiner* — Anthony M Liang
(74) *Attorney, Agent, or Firm* — Lei Fang; Smith Tempel Blaha LLC

(57) ABSTRACT

A free-cutting and non-quenched and tempered steel, comprising the following chemical elements by mass percentages: C: 0.35-0.45%, Si: 0.45-0.0.65%, Mn: 1.35-1.65%, S: 0.025-0.065%, V: 0.07-0.15%, Ti: 0.01-0.018%, N: 0.012-0.017%, Al: 0.015-0.035%, Ca: 0.0008-0.0025%, with the remaining being iron and other unavoidable impurities, wherein the S and Ca elements satisfy the relationship S/Ca=20-60. A manufacturing method of the free-cutting and non-quenched and tempered steel, comprising the following steps: (1) smelting and refining; (2) casting; (3) rolling; (4) forging; and (5) two-stage cooling.

10 Claims, 4 Drawing Sheets

FREE MACHINING AND NON-QUENCHED AND TEMPERED STEEL AND MANUFACTURING METHOD THEREFOR

CROSS-REFERENCE TO RELATED APPLICATIONS

This application is a 371 U.S. National Phase of PCT International Application No. PCT/CN2018/090627 filed on Jun. 11, 2018, which claims benefit and priority to Chinese patent application no. 201710514111.8, filed on Jun. 29, 2017. Both of the above-referenced applications are incorporated by reference herein in their entireties.

TECHNICAL FIELD

The present invention relates to a steel and a manufacturing method thereof, particularly to a non-quenched and tempered steel and a manufacturing method thereof.

BACKGROUND ART

Non-quenched and tempered steel originated from the second oil crisis. Motivated by energy-saving power, on the basis of microalloying technology, Thyssen (Germany) developed the first non-quenched and tempered forged steel 49MnVS3. Later, steel companies in countries such as the UK and France developed a series of non-quenched and tempered steels and formed international standard grades. In recent years, Japan has been the most active in studying non-quenched and tempered steel and at the advanced level in the world. Nippon Steel, KOBELCO, Aichi Steel, and Sanyo Special Steel have successively developed their respective non-quenched and tempered steel series. Compared with the international development, China's development of non-quenched and tempered steel started relatively late. In the 1990s, China developed steel grades such as F45MnV, F35MnVN, 35MnVS and 40MnVS.

With the rapid development of the automotive industry, automotive parts are required to be reliable, environmentally friendly and weight-reducing in view of automotive safety, stability and energy consumption. Moreover, the processing and manufacturing of automobile parts mainly using numerically-controlled machine tools puts higher and higher requirements on the machinability of materials. Therefore, high-strength, free-cutting and non-quenched and tempered steel becomes the best choice for automotive parts.

Non-quenched and tempered steel for automobile crankshafts is made by adding alloying elements to low- or medium-carbon manganese steel. Through fine grain strengthening and toughening and precipitation strengthening, the steel reaches the strength level of quenched and tempered steel and has a certain plastic toughness. Conventional free-cutting steels contain Pb element and have excellent processing properties. However, with the emphasis on environmental protection, such heavy metal element has been gradually eliminated due to its harmful effects on the environment. There is also a sulfur-containing free-cutting steel whose machinability improves with the increase of sulfur content. However, excessive sulfur tends to cause hot brittleness during rolling and forging processes. Therefore, a high-strength and toughness non-quenched and tempered steel which is a Pb-free free-cutting steel having excellent machinability is desired.

A technical solution of sulfur-containing free-cutting steel is disclosed in the prior art as an alternative to Pb-containing free-cutting steel. In this technical solution, 0.35% to 0.65% of sulfur is added to the low carbon steel, and the ratio of the sulfide is defined. However, the sulfur-containing free-cutting steel has a high sulfur content, making it easy to cause hot brittleness during rolling or forging of crankshafts.

Moreover, a technical solution of free-cutting steel for mechanical structural use having improved chip disposability is also disclosed in the prior art. A certain amount of oxygen is added to the steel, and the amount of the oxides per square millimeter is defined as no less than 10. However, excessive oxide inclusions have a great influence on the wear and life of the tool during processing.

SUMMARY OF THE INVENTION

One of the objects of the present invention is to provide a free-cutting and non-quenched and tempered steel. In view of the insufficient strength or high strength but low plastic toughness of the products in the prior art, the free-cutting and non-quenched and tempered steel achieves the improvement of material strength without reducing plastic toughness through the adjustment of alloy composition combined with the precipitation strengthening and fine grain strengthening effects of V, N and Ti.

In order to achieve the above object, the present invention provides a free-cutting and non-quenched and tempered steel, comprising the following chemical elements by mass percentages:

C: 0.35-0.45%, Si: 0.45-0.65%, Mn: 1.35-1.65%, S: 0.025-0.065%, V: 0.07-0.15%, Ti: 0.01-0.018%, N: 0.012-0.017%, Al: 0.015-0.035%, Ca: 0.0008-0.0025%, with the balance being iron and other unavoidable impurities; wherein the S and Ca elements satisfy the relationship of S/Ca=20-60.

The design principle of each chemical element in the free-cutting and non-quenched and tempered steel of the present invention is as follows:

Carbon: in the free-cutting and non-quenched and tempered steel according to the present invention, C has a great influence on the strength and toughness of the steel. The plastic toughness of the steel decreases as the mass percentage of C increases. Therefore, the lower the mass percentage of C, the better the plastic toughness of the steel. However, the C element is important for ensuring the strength of the steel. When the mass percentage of carbon is relatively low, the strength of the steel is insufficient. Therefore, in the free-cutting and non-quenched and tempered steel according to the present invention, the mass percentage of C is controlled to 0.35-0.45% so that the plastic toughness is not significantly lowered while the high strength is guaranteed.

Silicon: in the free-cutting and non-quenched and tempered steel according to the present invention, Si can increase the strength of the steel. By increasing the Si element, the strength of the steel can be increased to some extent. However, as the mass percentage of Si is further increased, it is easy to cause the formation of martensite structure in the steel. Therefore, in the free-cutting and non-quenched and tempered steel according to the present invention, the mass percentage of Si is controlled to 0.45-0.65%.

Manganese: in the free-cutting and non-quenched and tempered steel according to the present invention, in addition to being able to increase the strength, Mn, as an alloying element, also contributes to the toughness of steel when its mass percentage is within a certain range. When the mass percentage of Mn is relatively low, the strength of steel is insufficient. However, when the mass percentage of Mn is too high, it is not conducive to toughness, and the contribution of Mn to strength is also weak. Therefore, in the free-cutting and non-quenched and tempered steel according to the present invention, the mass percentage of Mn is controlled to 1.35-1.65%.

Sulfur: in the free-cutting and non-quenched and tempered steel according to the present invention, S is an element with hot brittleness and free-cutting machinability. It is known that the cutting machinability is improved as the mass percentage of sulfur increases but the hot workability deteriorates as the sulfur content increases. Therefore, for forging the free-cutting and non-quenched and tempered steel according to the present invention, the mass percentage of S should not be excessive, and the upper limit of the mass percentage of S is controlled to 0.065% or less. In addition, when the mass percentage of sulfur is less than 0.025%, the cutting machinability cannot be embodied. Therefore, in the technical solution of the present invention, the mass percentage of S is controlled to 0.025-0.065%.

Vanadium: V is an important precipitation strengthening element. The addition of about 0.1% by weight of V can form precipitates in ferrite and austenite, which greatly increases the strength of the material without affecting the plastic toughness. When the V content is too low, the strengthening effect is not significant. When the mass percentage of the added V is higher than 0.15%, the cost is increased but the effect of improving the steel performance is not significant. Therefore, in the free-cutting and non-quenched and tempered steel according to the present invention, the mass percentage of V is controlled to 0.07-0.15%.

Titanium: in the technical solution of the present invention, TiN or Ti(N, C) formed by adding Ti element to the steel is a stable second phase particle due to its high melting point, and can prevent grain growth during austenite recrystallization and refine grains. When the mass percentage of Ti is less than 0.01%, the inhibition of grain growth during forging process is not obvious. When the mass percentage of Ti exceeds 0.018%, too many particles are precipitated at the grain boundaries, resulting in weakening the grain boundaries and lowering the toughness of the material. Therefore, in the free-cutting and non-quenched and tempered steel according to the present invention, the mass percentage of Ti is controlled to 0.01-0.0.18%.

Nitrogen: N easily forms nitrides or nitrogen carbides with alloying elements such as V and Ti, resulting in grain refinement, which in turn enhances the toughness of steel by precipitation strengthening. However, when the mass percentage of N in the steel is too high, void defects are liable to occur. According to the influence of N on the properties of the free-cutting and non-quenched and tempered steel of the present invention, the inventors limited the mass percentage of N in the free-cutting and non-quenched and tempered steel of the present invention to 0.012-0.017%.

Aluminium: Al is added to the free-cutting and non-quenched and tempered steel of the present invention. On the one hand, Al is deoxidized during the steel making process, as is Si, and the resulting composite deoxidation product can effectively improve the swarf. On the other hand, AlN particles formed by Al and N can effectively refine grains, and avoid thermal defects such as overheating which affect the material properties during high-temperature heating. In order to achieve the above effects, the mass percentage of aluminum should be 0.015% or more. However, when the mass percentage of aluminum exceeds 0.035%, secondary oxidation tends to occur during casting. Therefore, in the free-cutting and non-quenched and tempered steel according to the present invention, the mass percentage of Al is limited to 0.015-0.035%.

Calcium: in the free-cutting and non-quenched and tempered steel according to the present invention, Ca improves the anisotropy by controlling the morphology of the sulfide, reduces the aspect ratio of MnS, and encapsulates oxides, and improves the machinability of the material. The above effects can be achieved by adding Ca in an amount of not less than 0.0008% by mass. However, when the mass percentage of calcium exceeds 0.0025%, the yield thereof is significantly reduced. Therefore, in the technical solution of the present invention, the mass percentage of Ca is controlled to 0.0008-0025%.

In the technical solution of the present invention, the morphology of MnS inclusions is controlled by the S/Ca ratio. It is found through experimental researches that when the S/Ca ratio is lower than 20, MnS is mostly present in the form of particles in the steel, which has a weak effect on cutting chip breaking. As the S/Ca ratio increases, the sulfide extends in the longitudinal direction such that its aspect ratio increases. When the S/Ca ratio exceeds 60, the sulfide is too long, which has a great negative impact on the mechanical properties of the steel. Therefore, the object of improving the strength and toughness performance and the machinability of the free-cutting and non-quenched and tempered steel according to the present invention can be achieved by controlling the S/Ca ratio in the range of 20 to 60.

Further, the free-cutting and non-quenched and tempered steel according to the present invention has a microstructure of ferrite+pearlite.

Further, in the free-cutting and non-quenched and tempered steel according to the present invention, in order to improve the cutting machinability of the material, the free-cutting and non-quenched and tempered steel has elongated MnS inclusions according to the distribution characteristics of MnS.

Further, in the free-cutting and non-quenched and tempered steel according to the present invention, the longitudinal direction of the elongated MnS substantially coincides with the rolling direction of steel sheet.

Further, in the free-cutting and non-quenched and tempered steel according to the present invention, the elongated MnS has an aspect ratio of 6.0 to 8.5.

Further, in the free-cutting and non-quenched and tempered steel according to the present invention, the proportion of the area of the elongated MnS in the section of the steel sheet of the free-cutting and non-quenched and tempered steel is 1.25 to 1.85%.

In the above solutions, during the metal machining process, the MnS inclusions serve as stress sources, which make the swarf easy to break, improve the cutting efficiency and reduce the tool wear. It is found through experimental researches that the aspect ratio and area proportion of MnS in the section have a certain relationship with machinability. Therefore, considering the relationship between the mechanical properties and machinability of steel, the aspect ratio of the elongated MnS is controlled to 6.0-8.5, and the proportion of the area of the elongated MnS in the section of the steel sheet of the free-cutting and non-quenched and tempered steel is 1.25 to 1.85%.

Further, the free-cutting and non-quenched and tempered steel of the present invention has a tensile strength (Rm) of 900 MPa or more, a yield strength (RP0.2) of 550 MPa or more, an elongation rate (A) of 18% or more, a reduction of area (Z) of 40% or more, and an impact energy (AKv) of 30 J or more.

Another object of the present invention is to provide a manufacturing method of the above-described free-cutting and non-quenched and tempered steel. The free-cutting and non-quenched and tempered steel obtained by the manufacturing method has a significantly higher strength than existing steels having the same plastic toughness. In addition, the steel has significantly improved machinability, and is particularly suitable for the manufacture of hot forging parts for automobiles such as crankshafts.

In order to achieve the above object, the present invention provides a manufacturing method of the free-cutting and non-quenched and tempered steel, comprising the following steps:

(1) smelting and refining;

(2) casting;

(3) rolling;

(4) forging;

(5) two-stage cooling: cooling to 650-700° C. at a cooling rate of 20-30° C./min in the first stage, and then air cooling to room temperature in the second stage.

The setting of the cooling rate and the selection of the heating temperature are designed based on the CCT curve of the steel grade. After the steel is forged, it is cooled from a high temperature at a cooling rate of 20-30° C./min. Cooling at a cooling rate within this range facilitates the formation of fine structure. However, there must be sufficient time for the structure to transform into ferrite and pearlite. Therefore, after cooling to 650-700° C., slow cooling is used to complete the transformation of the structure, thereby forming a very fine ferrite and pearlite sheet.

Further, in the manufacturing method of the present invention, in the step (1), tapping temperature is controlled to 1640-1660° C. during smelting.

Further, in the manufacturing method of the present invention, in the step (2), casting start temperature is controlled to 1530-1560° C.

Further, in the manufacturing method of the present invention, in the step (3), finishing rolling temperature is controlled to 950-1000° C.

Further, in the manufacturing method of the present invention, in the step (4), final forging temperature is controlled to 920-960° C.

The free-cutting and non-quenched and tempered steel according to the present invention solves the contradiction between high strength and low plastic toughness, and creatively utilizes the solute resistance of Ti in austenite recrystallization to suppress grain growth, and the precipitation strengthening effect of V, and provides N element required for precipitation of Ti and V. The steel of the present invention improves the strength of the material while ensuring the plastic toughness, so that the obtained free-cutting and non-quenched and tempered steel has a tensile strength (Rm) of 900 MPa or more, a yield strength (RP0.2) of 550 MPa or more, an elongation rate (A) of 18% or more, a reduction of area (Z) of 40% or more, and an impact energy (AKv) of 30 J or more. The aspect ratio of MnS inclusions in the longitudinal section is 6.0-8.5, and the proportion of the area of MnS inclusions is 1.25-1.85%.

Moreover, the free-cutting and non-quenched and tempered steel obtained by the manufacturing method has a significantly higher strength than existing steels having the same plastic toughness. In addition, the steel has a significantly improved machinability, and is particularly suitable for the manufacture of hot forging parts for automobiles such as crankshafts.

DETAILED DESCRIPTION

Figure 1:
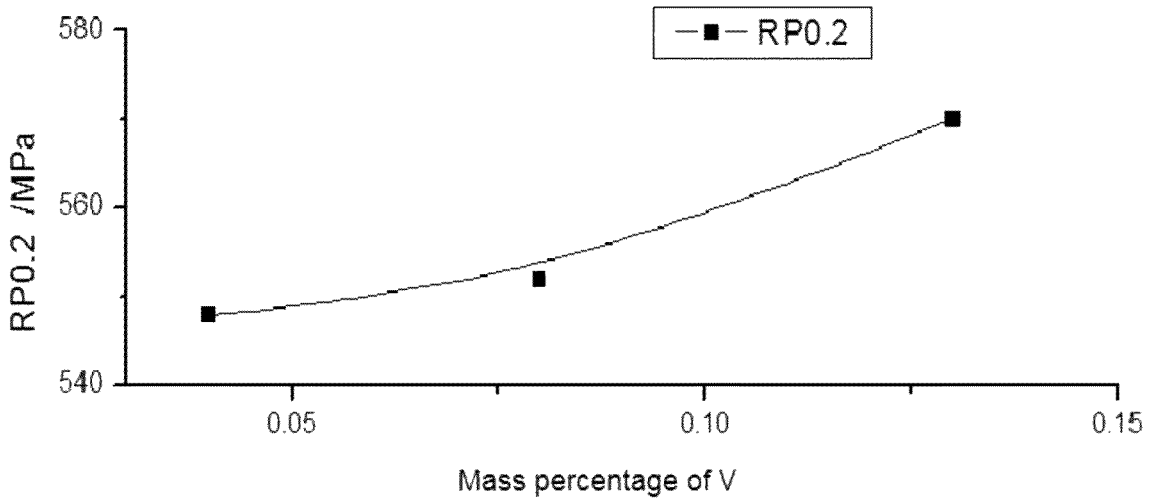
FIG. 1 illustrates the effect of the mass percentage of V on the yield strength of the free-cutting and non-quenched and tempered steel of the present invention.

The free-cutting and non-quenched and tempered steel of the present invention and the manufacturing method thereof will be further explained and illustrated below with reference to the accompanying drawings and specific Examples. However, the explanations and illustrations do not unduly limit the technical solutions of the present invention.

Examples 1-7 and Comparative Example 1

Table 1 lists the mass percentages of the chemical elements in the free-cutting and non-quenched and tempered steels of Examples 1-7 and the conventional steel of Comparative Example 1.

TABLE 1

(wt %, the balance is Fe and other inevitable impurity elements other than P)

| Number | C | Si | Mn | P | S | V | Ti | N | Al | Ca | S/Ca |
|---|---|---|---|---|---|---|---|---|---|---|---|
| Example 1 | 0.35 | 0.55 | 1.65 | 0.01 | 0.051 | 0.13 | 0.015 | 0.012 | 0.02 | 0.0021 | 24.3 |
| Example 2 | 0.38 | 0.65 | 1.6 | 0.008 | 0.065 | 0.11 | 0.012 | 0.014 | 0.018 | 0.0024 | 27.08 |
| Example 3 | 0.41 | 0.5 | 1.5 | 0.008 | 0.037 | 0.12 | 0.018 | 0.013 | 0.032 | 0.0016 | 23.16 |
| Example 4 | 0.43 | 0.45 | 1.35 | 0.009 | 0.025 | 0.09 | 0.01 | 0.015 | 0.026 | 0.0008 | 31.25 |
| Example 5 | 0.45 | 0.47 | 1.4 | 0.007 | 0.044 | 0.1 | 0.015 | 0.017 | 0.034 | 0.001 | 44 |

TABLE 1-continued (wt %, the balance is Fe and other inevitable impurity elements other than P)

| Number | C | Si | Mn | P | S | V | Ti | N | Al | Ca | S/Ca |
|---|---|---|---|---|---|---|---|---|---|---|---|
| Example 6 | 0.37 | 0.58 | 1.45 | 0.012 | 0.031 | 0.07 | 0.018 | 0.014 | 0.028 | 0.0012 | 25.83 |
| Example 7 | 0.4 | 0.62 | 1.55 | 0.007 | 0.058 | 0.14 | 0.013 | 0.015 | 0.023 | 0.0018 | 32.22 |
| Comparative Example 1 | 0.42 | 0.5 | 1.35 | 0.012 | ***0.015*** | 0.11 | — | 0.015 | — | — | — |

The manufacturing method of the free-cutting and non-quenched and tempered steels of Examples 1-7 and the conventional steel of Comparative Example 1 comprises the following steps:

(1) smelting and refining: tapping temperature was controlled to 1640-1660° C. during smelting;

(2) casting: casting start temperature was controlled to 1530-1560° C.;

(3) rolling: finishing rolling temperature was controlled to 950-1000° C.;

(4) forging: final forging temperature was controlled to 920-960° C.;

(5) two-stage cooling: cooling to 650-700° C. at a cooling rate of 20-30° C./min in the first stage, and then air cooling to room temperature in the second stage.

Table 2 lists the specific process parameters in the manufacturing method of the free-cutting and non-quenched and tempered steels of Examples 1-7 and the conventional steel of Comparative Example 1.

TABLE 2

| Number | Step (1) Tapping temperature (° C.) | Step (2) Casting start temperature (° C.) | Step (3) Rolling temperature (° C.) | Step (4) Final forging temperature (° C.) | Step (5) Cooling rate (° C./mm) | Step (5) Final cooling temperature (° C.) | Micro-structure |
|---|---|---|---|---|---|---|---|
| Example 1 | 1650 | 1552 | 975 | 958 | 25 | 680 | F + P |
| Example 2 | 1640 | 1531 | 955 | 930 | 22 | 655 | F + P |
| Example 3 | 1645 | 1542 | 980 | 948 | 27 | 678 | F + P |
| Example 4 | 1659 | 1557 | 995 | 955 | 21 | 690 | F + P |
| Example 5 | 1655 | 1535 | 985 | 928 | 29 | 650 | F + P |
| Example 6 | 1653 | 1548 | 967 | 952 | 24 | 700 | F + P |
| Comparative Example 1 | 1653 | 1552 | 982 | 958 | 26 | 690 | F + P |

Note:
"F + P" in Table 2 represents ferrite + pearlite.

Performance tests were performed on the free-cutting and non-quenched and tempered steels of Examples 1-7 and the conventional steel of Comparative Example 1, and the results are shown in Table 3.

TABLE 3

| Number | RP0.2(MPa) | Rm(Mpa) | A(%) | Z(%) | AKv (J) |
|---|---|---|---|---|---|
| Example 1 | 588 | 924 | 19.5 | 54 | 32 |
| Example 2 | 574 | 920 | 20.5 | 52 | 34 |
| Example 3 | 580 | 902 | 19.0 | 44 | 35 |
| Example 4 | 582 | 918 | 19.5 | 48 | 32 |
| Example 5 | 603 | 932 | 19.5 | 46 | 31 |
| Example 6 | 596 | 917 | 18.0 | 42 | 33 |
| Example 7 | 585 | 912 | 19.0 | 48 | 32 |
| Comparative Example 1 | 535 | 855 | 16 | 38 | 28 |

As can be seen from Table 3, each of the free-cutting and non-quenched and tempered steels of Examples 1-7 has a tensile strength (Rm) of 900 MPa or more, a yield strength (RP0.2) of 550 MPa or more, an elongation rate (A) of 18% or more, a reduction of area (Z) of 40% or more, and an impact energy (AKv) of 30 J or more. The performance parameters of the steels of the Examples are superior to those of the conventional steel of Comparative Example 1.

Further, the free-cutting and non-quenched and tempered steels of Examples 1-7 and the conventional steel of Comparative Example 1 were turned on the same numerically controlled machine tool at a machine speed of 400 r/min. The amount of tool loss after turning for 1 hour is shown in Table 4.

TABLE 4

| Number | Tool loss (mm) |
|---|---|
| Example 1-7 | 0.2 |
| Comparative Example 1 | 0.6 |

As can be seen from Table 4, the average tool loss of Examples 1-7 is 0.2 mm, while the tool loss of Comparative Example 1 is 0.6 mm. The average loss of the cutting tool caused by Examples 1-7 is ⅓ of Comparative Example 1.

Figure 2:
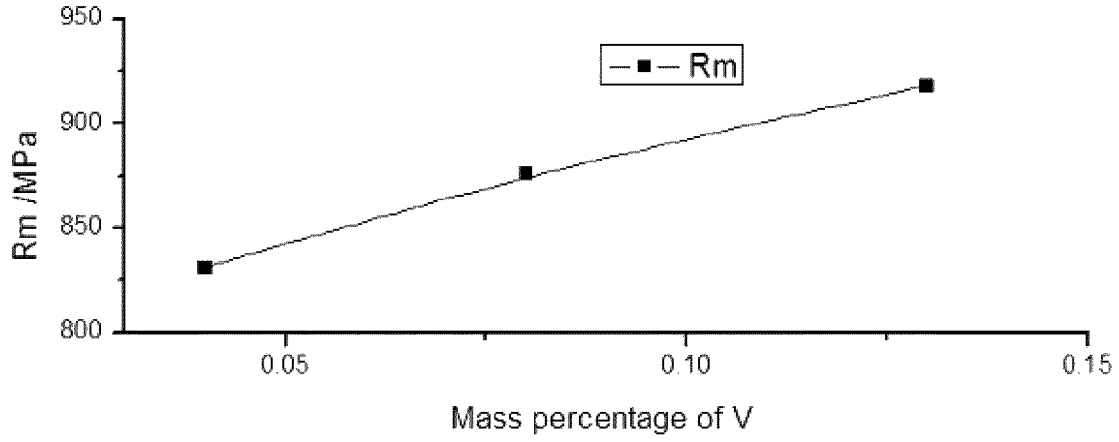
FIG. 2 illustrates the effect of the mass percentage of V on the tensile strength of the free-cutting and non-quenched and tempered steel of the present invention.

FIG. 1 illustrates the effect of the mass percentage of V on the yield strength of the free-cutting and non-quenched and tempered steel of the present invention. FIG. 2 illustrates the effect of the mass percentage of V on the tensil strength of the free-cutting and non-quenched and tempered steel of the present invention.

As shown in FIG. 1 and FIG. 2, when the mass percentage of V is 0.07-0.15%, the improvement of the yield strength and tensile strength is remarkable. Considering the manufacture cost and the improvement effect of the strength of the steel, the mass percentage in the free-cutting and non-quenched and tempered steel of the present invention is controlled to 0.07-0.15%.

Figure 3:
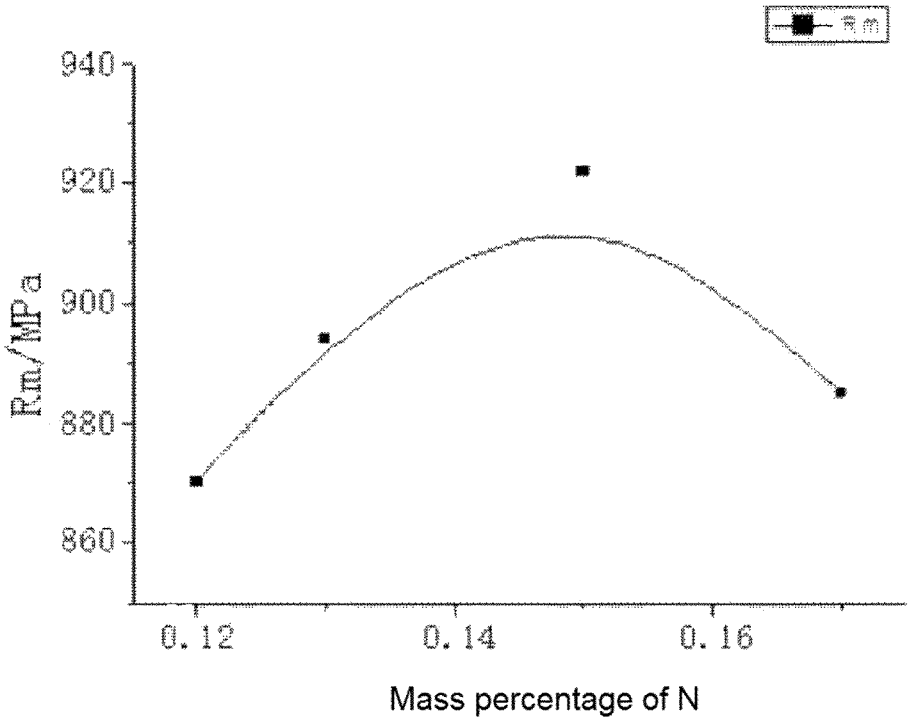
FIG. 3 illustrates the effect of the mass percentage of N on the tensile strength of the free-cutting and non-quenched and tempered steel of the present invention.
Figure 4:
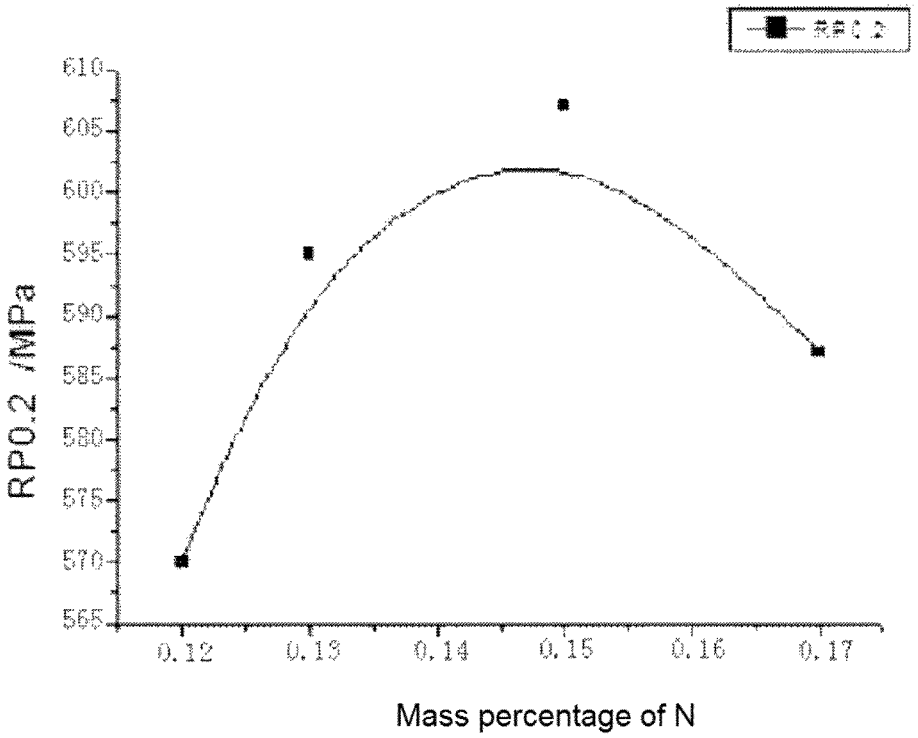
FIG. 4 illustrates the effect of the mass percentage of N on the yield strength of the free-cutting and non-quenched and tempered steel of the present invention.
Figure 5:
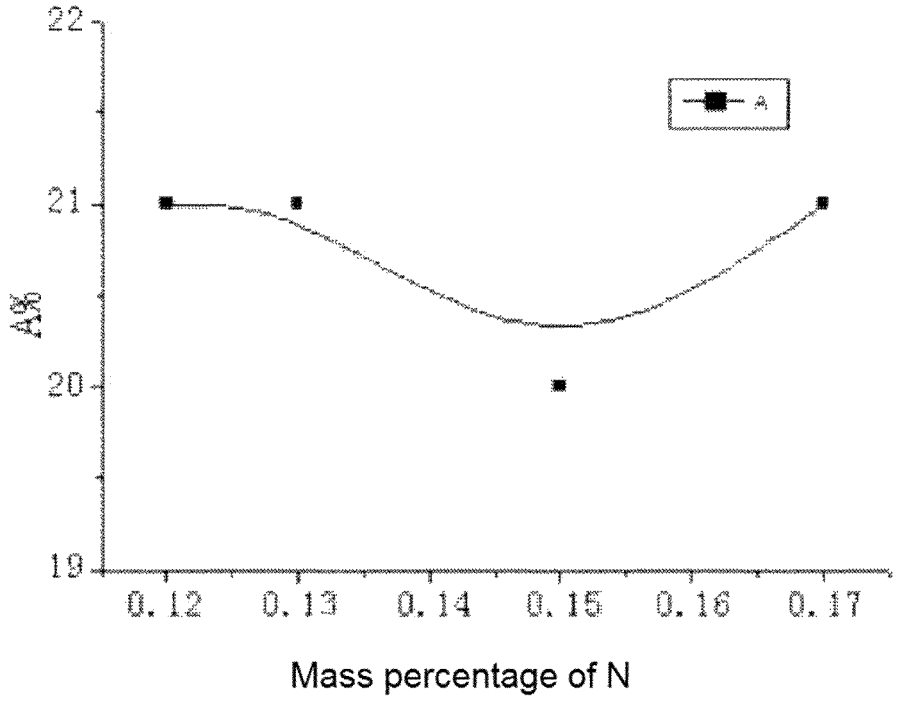
FIG. 5 illustrates the effect of the mass percentage of N on the elongation rate of the free-cutting and non-quenched and tempered steel of the present invention.
Figure 6:
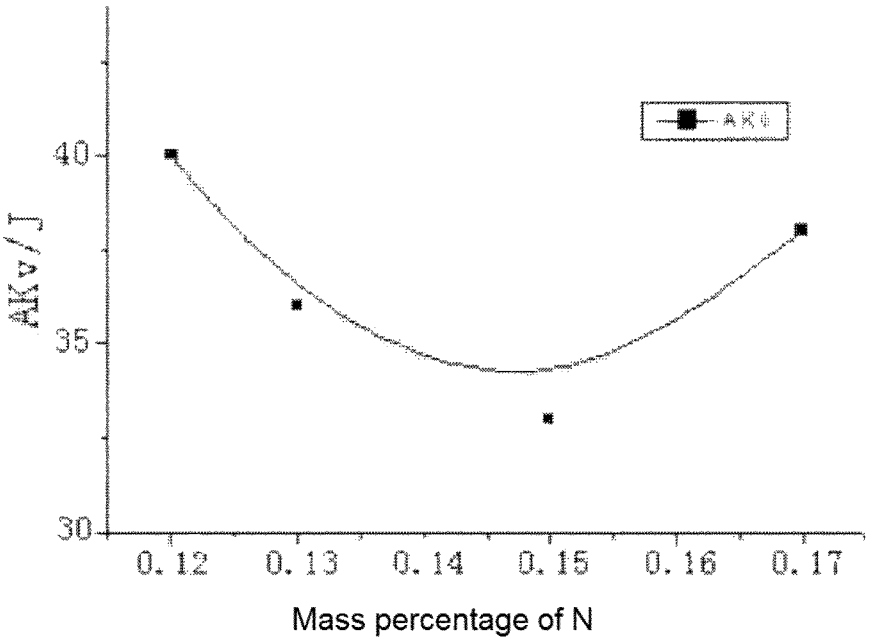
FIG. 6 illustrates the effect of the mass percentage of N on the impact energy of the free-cutting and non-quenched and tempered steel of the present invention.

FIG. 3 illustrates the effect of the mass percentage of N on the tensile strength of the free-cutting and non-quenched and tempered steel of the present invention. FIG. 4 illustrates the effect of the mass percentage of N on the yield strength of the free-cutting and non-quenched and tempered steel of the present invention. FIG. 5 illustrates the effect of the mass percentage of N on the elongation rate of the free-cutting and non-quenched and tempered steel of the present invention. FIG. 6 illustrates the effect of the mass percentage of N on the impact energy of the free-cutting and non-quenched and tempered steel of the present invention.

As shown in FIG. 3 to FIG. 6, when the mass percentage of N added is different, the effect of improving the performance of the steel is different. Considering the cost of addition and the effect of improvement, the inventor of the present invention limited the mass percentage of N to 0.12-0.17%. When the mass percentage of N is within this range, it is beneficial to increasing the strength of the steel, and N easily forms nitrides or nitrogen carbides with alloying elements such as V and Ti, resulting in grain refinement, which in turn enhances the toughness of steel by precipitation strengthening. In addition, void defects due to over-high mass percentage of N in the steel can be avoided.

Figure 7:
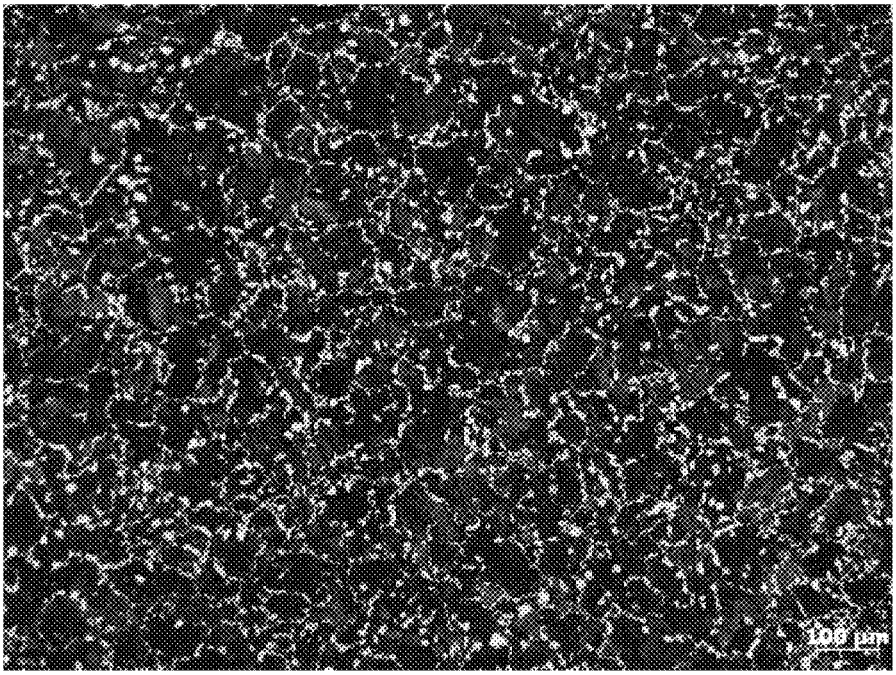
FIG. 7 shows the metallographic structure of the free-cutting and non-quenched and tempered steel of Example 3.

FIG. 7 shows the metallographic structure of the free-cutting and non-quenched and tempered steel of Example 3.

As shown in FIG. 7, the free-cutting and non-quenched and tempered steel of Example 3 has a microstructure of ferrite+pearlite.

Figure 8:
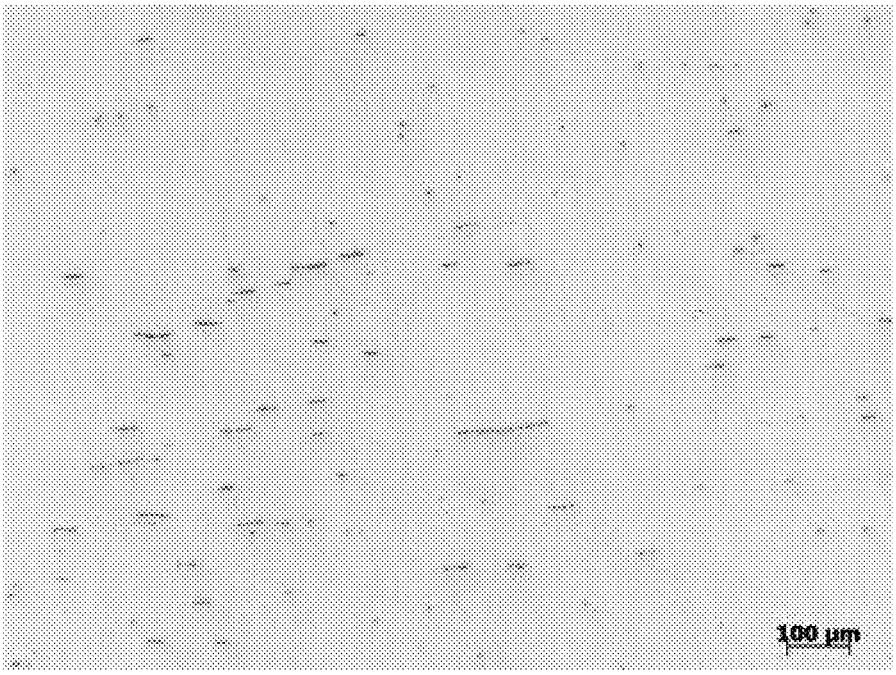
FIG. 8 shows the metallographic structure of MnS inclusions in the free-cutting and non-quenched and tempered steel of Example 3.

FIG. 8 shows the metallographic structure of MnS inclusions in the free-cutting and non-quenched and tempered steel of Example 3.

As shown in FIG. 8, the free-cutting and non-quenched and tempered steel of Example 3 has elongated MnS inclusions, the longitudinal direction of the elongated MnS substantially coincides with the rolling direction of the steel sheet, the elongated MnS has an aspect ratio of 6.0 to 8.5, and through calculation the proportion of the area of the elongated MnS in the section of the steel sheet of the free-cutting and non-quenched and tempered steel is 1.25 to 1.85%.

It should be noted that the above is merely an illustration of specific Examples of the invention. It is obvious that the present invention is not limited to the above Examples, but has many similar variations. All variations that are directly derived or conceived by those skilled in the art from this disclosure are intended to be within the scope of the present invention.

The invention claimed is:

1. A free-cutting and non-quenched and non-tempered steel, comprising the following chemical elements by mass percentages:

C: 0.35-0.45%, Si: 0.45-0.65%, Mn: 1.35-1.65%, S: 0.025-0.065%, V: 0.07-0.15%, Ti: 0.01-0.018%, N: 0.012-0.017%, Al: 0.015-0.035%, Ca: 0.0008-0.0025%, with the balance being iron and other unavoidable impurities; wherein the contents of S and Ca satisfy the relationship of S/Ca=20-60, wherein the steel has elongated MnS inclusions, and wherein the elongated MnS inclusions have an aspect ratio of 6.0 to 8.5.

2. The free-cutting and non-quenched and non-tempered steel as claimed in claim 1, wherein the steel has a microstructure of ferrite and pearlite.

3. The free-cutting and non-quenched and non-tempered steel as claimed in claim 1, wherein a longitudinal direction of the elongated MnS inclusions coincides with a rolling direction of the steel.

4. The free-cutting and non-quenched and non-tempered steel as claimed in claim 1, wherein a proportion of an area of the elongated MnS inclusions in a section of the steel is 1.25 to 1.85%.

5. The free-cutting and non-quenched and non-tempered steel as claimed in claim 1, wherein the steel has a tensile strength (Rm) of 900 MPa or more, a yield strength (RP0.2) of 550 MPa or more, an elongation rate (A) of 18% or more, a reduction of area (Z) of 40% or more, and an impact energy (AKv) of 30 J or more.

6. A manufacturing method of the free-cutting and non-quenched and non-tempered steel as claimed in claim 1, comprising the following steps:

(1) smelting and refining;

(2) casting;

(3) rolling;

(4) forging; and (5) two-stage cooling: cooling to 650-700° C. at a cooling rate of 20-30 ° C/min in the first stage, and then air cooling to room temperature in the second stage.

7. The manufacturing method as claimed in claim 6, wherein in the step (1), tapping temperature is controlled to 1640-1660 ° C. during the smelting.

8. The manufacturing method as claimed in claim 6, wherein in the step (2), casting start temperature is controlled to 1530-1560 ° C.

9. The manufacturing method as claimed in claim 6, wherein in the step (3), finishing rolling temperature is controlled to 950-1000 ° C.

10. The manufacturing method as claimed in claim 6, wherein in the step (4), final forging temperature is controlled to 920-960 ° C.

* * * * *